US007921666B2

(12) United States Patent
Lee

(10) Patent No.: US 7,921,666 B2
(45) Date of Patent: Apr. 12, 2011

(54) REFRIGERATOR WITH ICEMAKER

(75) Inventor: Wook Yong Lee, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 394 days.

(21) Appl. No.: 11/989,891

(22) PCT Filed: Feb. 1, 2005

(86) PCT No.: PCT/KR2005/000294
§ 371 (c)(1),
(2), (4) Date: Oct. 8, 2008

(87) PCT Pub. No.: WO2006/083047
PCT Pub. Date: Aug. 10, 2006

(65) Prior Publication Data

US 2009/0095009 A1 Apr. 16, 2009

(51) Int. Cl.
*F25C 5/18* (2006.01)

(52) U.S. Cl. ..... 62/320; 62/344

(58) Field of Classification Search ..... 62/344, 62/353, 320
See application file for complete search history.

(56) References Cited

U.S. PATENT DOCUMENTS

| | | | | |
|---|---|---|---|---|
| 3,798,923 | A * | 3/1974 | Pink et al. | 62/266 |
| 3,937,365 | A | 2/1976 | Shelley et al. | |
| 4,614,088 | A * | 9/1986 | Brooks | 62/137 |
| 5,947,342 | A * | 9/1999 | Song | 222/413 |
| 7,065,975 | B1 * | 6/2006 | Herndon et al. | 62/66 |
| 7,263,854 | B2 * | 9/2007 | Lee et al. | 62/351 |
| 7,266,951 | B2 * | 9/2007 | Anselmino et al. | 62/66 |
| 2001/0027654 | A1 | 10/2001 | Shapiro et al. | |

FOREIGN PATENT DOCUMENTS

| | | |
|---|---|---|
| EP | 1482263 | 12/2004 |
| JP | 2000-031445 | 1/2002 |
| KR | 10-1998-0083739 A | 12/1998 |

OTHER PUBLICATIONS

Korean Office Action dated Jun. 27, 2005 for Application No. 10-2003-0059509.

* cited by examiner

*Primary Examiner* — William E Tapolcai
(74) *Attorney, Agent, or Firm* — KED & Associates LLP

(57) ABSTRACT

A refrigerator with an icemaker (100) is disclosed, having an improved structure for supplying ice to a user of the outside through a dispenser (30) provided in a door (25), which includes a dispenser (30) provided in a door (25); an icemaker (100) for making ice by using a cool air of a freezer; a container (200) for receiving and storing the ice discharged from the icemaker; and a lifter (300) provided between the dispenser and the container, for lifting the ice stored in the container to the dispenser.

15 Claims, 8 Drawing Sheets

REFRIGERATOR WITH ICEMAKER

TECHNICAL FIELD

The present invention relates to a refrigerator, and more particularly, to a refrigerator with an icemaker having an improved structure for supplying ice to a user of the outside through a dispenser provided in a door.

BACKGROUND ART

A refrigerator is an apparatus for storing foods freshly for a long time, in which a food storage chamber is provided. The food storage chamber is always maintained at a low temperature by a refrigerating cycle for keeping foods fresh.

The food storage chamber is divided into a plurality of storage chambers having different characteristics from each other such that a user can choose a food-storage method in due consideration of the kind, characteristic and expiration date of food. Typical examples of the storage chambers are a cooling chamber and a freezer.

The cooling chamber keeps a temperature at about 3° C.-4° C. for keeping foods and vegetables fresh for a long time. The freezer keeps a temperature at a sub-zero temperature for keeping and storing meat and fish frozen for a long time, and making and storing ice.

In the meantime, the refrigerator is developed for performing various additional functions besides a typical function thereof. For example, the user had to open a door and take out a water bottle kept in the cooling chamber so as to drink cold water.

However, a refrigerator having a water dispenser provided at the outside of the door has been recently developed. That is, it is possible to provide the water cooled by a cool air of the cooling chamber to the user without opening the door. Furthermore, a product with water purifying function being added to the water dispenser is being supplied.

Also, when the user wants to drink water or beverage with the ice, the user has to open the door of the freezer, and use the ice by separating the ice stored in an ice tray therefrom, thereby generating a user's inconvenience. In addition, when the door is open, the cool air of the freezer leaks out, whereby a temperature of the freezer goes up. Necessarily, a compressor works more, so that it has a problem of wasting energy.

DISCLOSURE OF INVENTION

An object of the present invention, designed for solving the foregoing problems, is to provide a refrigerator with an icemaker having an improved structure for supplying ice to a user of the outside through a dispenser provided in a door, without opening the door.

Another object of the present invention, designed for solving the foregoing problems, is to provide a refrigerator having an improved structure, in which a user can have ice without bending downward.

The object of the present invention can be achieved by providing a refrigerator, the refrigerator includes refrigerator having an icemaker comprising a dispenser provided in a door; an icemaker for making ice by using a cool air of a freezer; a container for receiving and storing the ice discharged from the icemaker; and a lifter provided between the dispenser and the container, for lifting the ice stored in the container to the dispenser.

At this time, the freezer is positioned in a lower part of the refrigerator, and a cooling chamber is positioned in an upper part of the refrigerator. Also, the door is provided to open and close the cooling chamber positioned above the freezer.

The icemaker includes an ice tray for receiving water therein; and an ejector rotatably provided above the ice tray, for discharging the ice of the ice tray. At this time, the icemaker further includes inclined strips being extended from an upper part of the ice tray, for guiding the ice discharged to an upper side by the ejector. Furthermore, the icemaker further includes a sensing arm being intermittently moved downward for measuring the amount of ice stored in the container.

In the meantime, the container is positioned below the ice tray, and has an open top for receiving the ice dropped from the icemaker. Also, the lifter is extended from the cooling chamber to the freezer.

In addition, the refrigerator further includes a duct for forming a path of ice transported by the lifter, between the dispenser and the container. Also, the duct may be extended from the cooling chamber to the freezer.

In another aspect, the lifter includes a shaft rotatably provided between the container and the dispenser; and a helical blade provided on an outer circumferential surface of the shaft, for being rotated together with the shaft to lift the ice stored in the container to the dispenser.

In another aspect, the lifter includes a conveyor belt having a lower end being positioned adjacent to the container, and having an upper end being positioned adjacent to the dispenser; and a bucket being projected from an outer surface of the conveyor belt, for transporting the ice of the container to the dispenser according to the rotation of the conveyor belt.

In another aspect, the lifter includes a bucket provided between the container and the dispenser, for lifting the ice stored in the container to the dispenser; and an elevating mechanism being connected with the bucket, for moving up the bucket in the duct. At this time, the elevating mechanism includes a rack being connected with the bucket; and a pinion being engaged with the rack.

In the meantime, the refrigerator further includes a crusher assembly provided between the lifter and the dispenser, for crushing the ice transported by the lifter, and supplying the crushed to the dispenser. The crusher assembly includes an auxiliary container for storing the ice transported by the lifter; a crushing blade rotatably provided in the auxiliary container, for crushing the ice; and a shutter provided in the auxiliary container, for supplying the crushed ice to the dispenser.

BRIEF DESCRIPTION OF DRAWINGS

The accompanying drawings, which are included to provide a further understanding of the invention, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. In describing the embodiments, parts the same with the related art fuel cell will be given the same names and reference symbols, and detailed description of which will be omitted.

Hereinafter, a refrigerator according to the present invention will be described with reference to the accompanying drawings.

Figure 1:
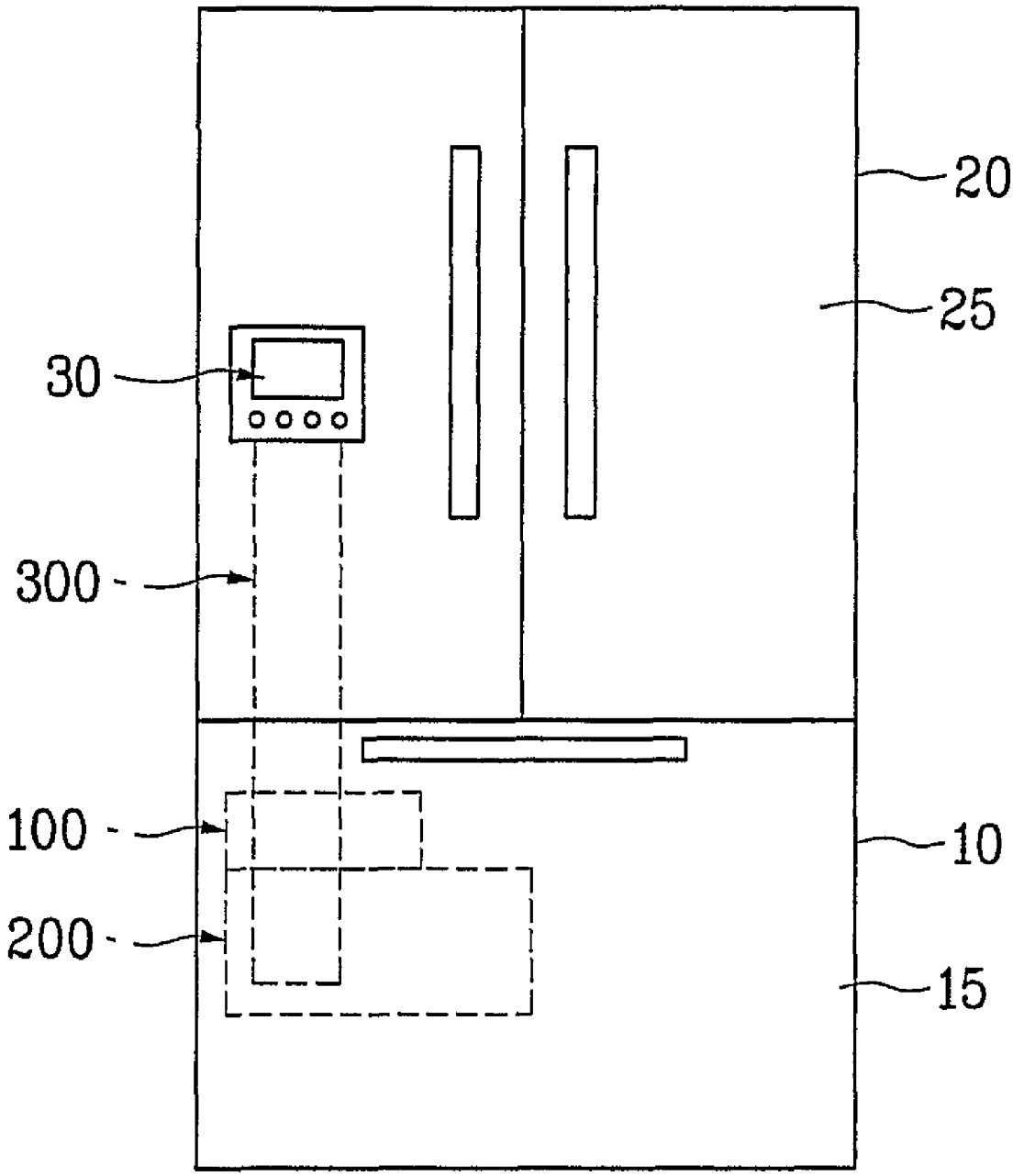
FIG. 1 is a diagram of schematically illustrating a refrigerator according to the present invention.

In case of a general refrigerator, a cooling chamber is positioned in a lower part, and a freezer is positioned in an upper part. However, in case of a refrigerator according to the present invention, a freezer 10 is positioned in a lower part, and a cooling chamber 20 is positioned above the freezer 10, as shown in FIG. 1. Also, a door 15 for opening and closing the freezer 10 is provided in a lower front part of the refrigerator, and another door 25 for opening and closing the cooling chamber 20 is provided in an upper front part of the refrigerator.

In addition, a dispenser 30 is provided in the door 25 for opening and closing the cooling chamber 20. The dispenser 30 enables a user to be supplied with cold water and ice at the outside of the refrigerator without opening the door 25. For example, the dispenser 30 is positioned in correspondence to a waist or breast height of the user, so that the user can have water and ice without bending down. In this case, a height of the dispenser 30 is determined in due consideration of the average height of people or housewives in the country where the refrigerators are provided.

For supplying the cool water to the user through the dispenser 30, the door 25 of the cooling chamber 20 is provided with a water tank (not shown). The water tank stores water, and the water stored in the water tank is cooled by a cool air of the cooling chamber 20. Accordingly, the user can be supplied with the cool water through the dispenser 30 at the outside of the refrigerator without opening the door 25.

For supplying the ice to the user through the dispenser 30, as shown in FIG. 1, the refrigerator is provided with an icemaker 100, a container 200, and a lifter 300. At this time, the icemaker 100 makes the ice with a cool air of the freezer 10. The container 200 stores the ice made by the icemaker 100, and the lifter 300 transfers the ice stored in the container 200 to the dispenser 30. This will be described in detail.

Figure 2:
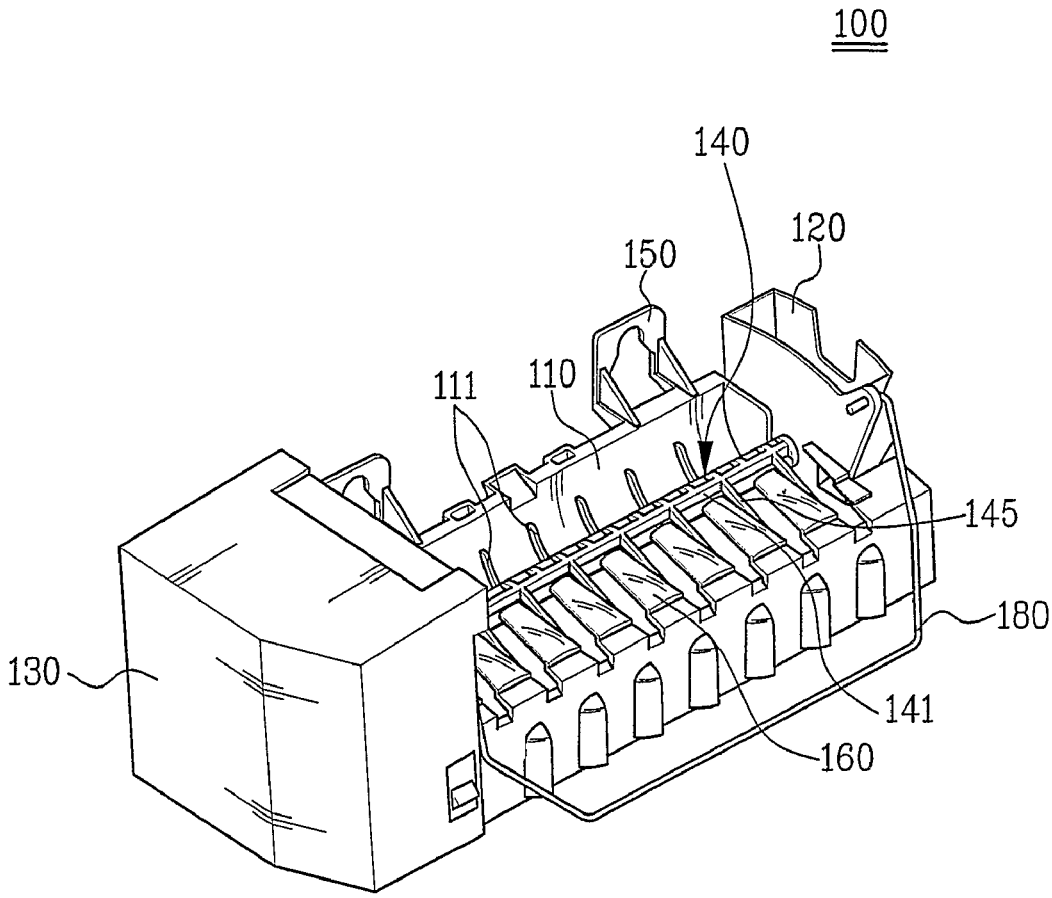
FIG. 2 is a perspective view of illustrating an icemaker in a refrigerator of FIG. 1.

First, as shown in FIG. 1, the icemaker 100 is provided in the freezer 10 positioned in the lower part of the refrigerator. As shown in FIG. 2, the icemaker 100 includes an ice tray 110 for receiving the water therein. The ice tray 110 is formed in a semi-cylindrical shape with an open top, for storing the water and ice therein, as shown in FIG. 2. Also, the ice tray 110 is provided with a plurality of ribs 111, wherein the plurality of ribs 111 divide the inside of the ice tray 110 into a plurality of spaces. As shown in FIG. 2, the ribs 111 are projected in a radial direction. Also, the ribs 111 enable the ice tray 110 to make a plurality of small pieces of ice.

As shown in FIG. 2, a water supplying part 120 is provided next to the ice tray 110, to supply the water to the ice tray 110. Also, there is a bracket 150 at a rear side of the ice tray 110, for fastening the icemaker 100 to the freezer 10.

Also, an ejector 140 is provided above the ice tray 110, wherein the ejector 140 rotates to discharge the ice stored in the ice tray 110. For example, the ejector 140 is provided with a shaft 141 and a plurality of pins 145. As shown in FIG. 2, the shaft 141 is positioned in the ice tray 110 along a longitudinal direction. Also, the plurality of pins 145 are provided on an outer circumferential surface of the shaft 141, for being in perpendicular to the shaft 141. Preferably, the plurality of pins 145 are formed along the longitudinal direction of the shaft 141 at fixed intervals. Especially, each of the pins 145 is provided in each of the spaces divided by the plurality of ribs 111 in the ice tray 110.

Also, a motor 130 is connected with the ice tray 110, wherein the motor 130 rotates the ejector 140. The motor 130 is provided at one end of the ice tray 110, being opposite to the other end having the water supplying part 120. As shown in FIG. 2, the motor 130 is connected with the shaft 141. Accordingly, as the motor 130 drives, the shaft 141 of the ejector 140 rotates, so that the pins 145 rotate together with the shaft 141. Thus, the ice stored in the ice tray 110 is discharged through the open top of the ice tray 110.

Figure 3:
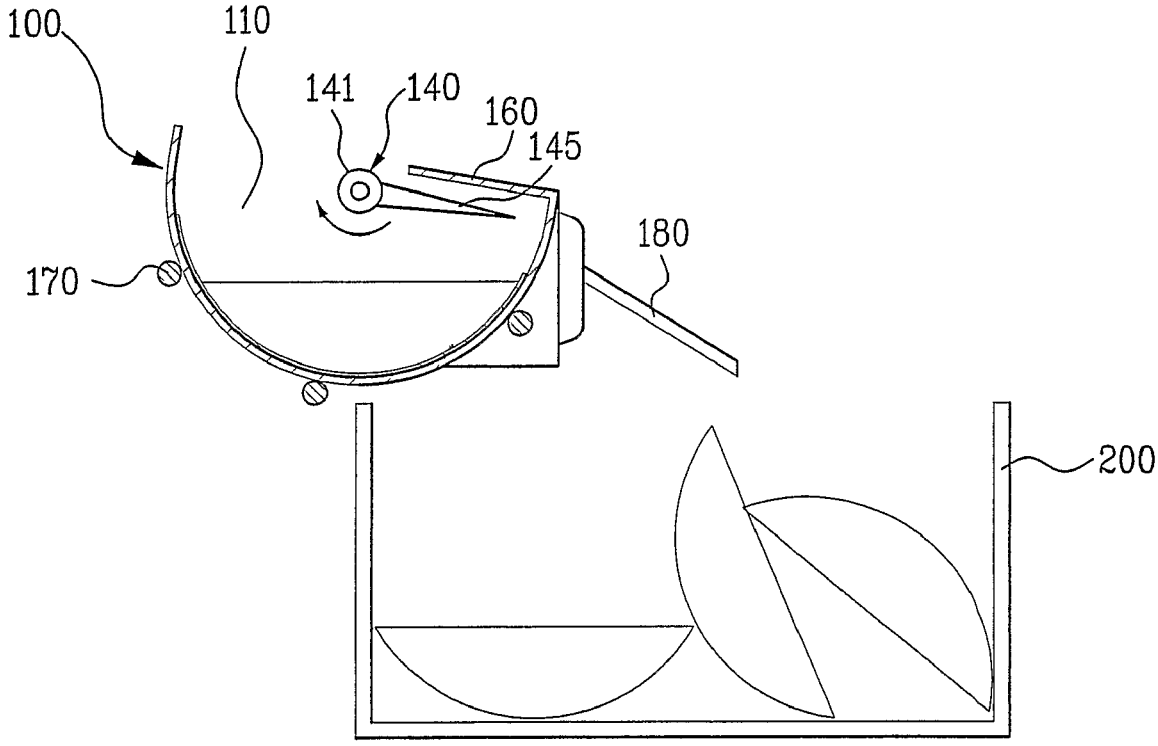
FIG. 3 is a diagram of schematically illustrating the process for making ice by an icemaker of FIG. 2.

Referring to FIG. 3, a plurality of strips 160 are provided at an upper part of a front side of the ice tray 110. The strips 160 are extended from the upper part of the front side of the ice tray 110 close to the shaft 141, respectively. In this state, there is a small gap between the adjacent strips 160. That is, when the shaft 141 rotates, the pins 145 pass through the small gap formed between the adjacent strips 160.

In the meantime, the pieces of ice in the ice tray 110 are pushed by the pins 145 when the shaft 141 rotates, so that the pieces of ice are separated from the ice tray 110, and dropped to the strips 160. Then, the pieces of ice dropped on the strips 160 are dropped to the lower side of the icemaker 100.

Accordingly, the top of the strip 160 has the shape suitable for guiding the piece of ice separated from the ice tray 110 to the lower side. Thus, as shown in FIG. 2 and FIG. 3, the strip 160 has a sloped structure such that a part of the strip 160, near to the shaft 141, is positioned for being higher than the front side of the ice tray 110.

Also, it is necessary to obtain a structure for preventing the pieces of ice, separated from the ice tray 110 by the pins 145, from being dropped to a rear side of the ice tray 110. For this, as shown in FIG. 2 and FIG. 3, it is preferable to position a rear end of the ice tray 110 for being higher than the shaft 141. According as the pieces of ice separated from the ice tray 110 moves toward the rear side of the ice tray 110 by the pins 145, the pieces of ice are smoothly guided to the front side of the ice tray 110, and then dropped on the top surface of the strips 160.

In the meantime, as shown in FIG. 3, a heater 170 is provided on the lower surface of the ice tray 110. The heater 170 heats the surface of the ice tray 110 for a short time, and slightly melts the ice on the surface of the ice tray 11. Accordingly, the pieces of ice in the ice tray 11 are easily separated from the ice tray 110 when the shaft 141 and the plurality of fins 145 rotate.

Referring to FIG. 2 and FIG. 3, the icemaker 100 further includes a sensing arm 180 for measuring the amount of ice stored in the container 200. By a controller (not shown), the sensing arm 180 is moved up and down so as to measure the amount of ice in the container 200. For example, the sensing arm 180 is periodically moved downward. During moving the sensing arm 180 downward, if the amount of ice stored in the container 200 is small, the sensing arm 180 moves down to a great extent. On the contrary, if the amount of ice stored in the container 200 is large, the sensing arm 180 is bumped into the ice, whereby the sensing arm 180 moves down to a small extent. Accordingly, the controller measures the amount of ice stored in the container 200 according to the extent of moving the sensing arm 180 downward.

As shown in FIG. 1 and FIG. 3, the container 200 is positioned below the icemaker 100, wherein the container 200 has an open top for receiving and storing the ice dropped from the icemaker 100. The container 200 has an appropriate size in due consideration of the amount of storing the ice and a capacity of the refrigerator.

In case of the present invention, the icemaker 100 and the container 200 are provided in the freezer 10 positioned in the lower part of the refrigerator. Also, the dispenser 30 is provided in the door 25 for opening and closing the cooling chamber 20 positioned above the freezer 10. Accordingly, there is requirement for transporting the ice stored in the container 200 of the freezer 10 to the door 25 of the cooling chamber 20.

For this, the lifter 300 and a duct 310 are provided between the container 200 and the dispenser 30, wherein the lifter 300 lifts up the ice, and the duct 310 forms a transport passage for the ice. Hereinafter, the lifter 300 and the duct 310 will be described with reference to FIG. 4 to FIG. 7. For realizing the simplicity in the drawings, the dispenser 30 will be not be shown in FIG. 4 to FIG. 7.

First, the duct 310 is extended from the freezer 10 to the cooling chamber 20. In this state, a lower end of the duct 310 is in communication with the container 200 positioned in the freezer 10, and an upper end of the duct 310 is in communication with the dispenser 30 positioned in the door 25 of the cooling chamber 20. The duct 310 may be buried in a body of the refrigerator, or may be adhered to the body. Also, it is possible to provide the duct 310 passing through a wall for dividing the inner space of the refrigerator into the freezer 10 and the cooling chamber 20. Furthermore, the duct 310 may be positioned vertically or slantingly, as shown in FIG. 4 to FIG. 7.

Figure 4:
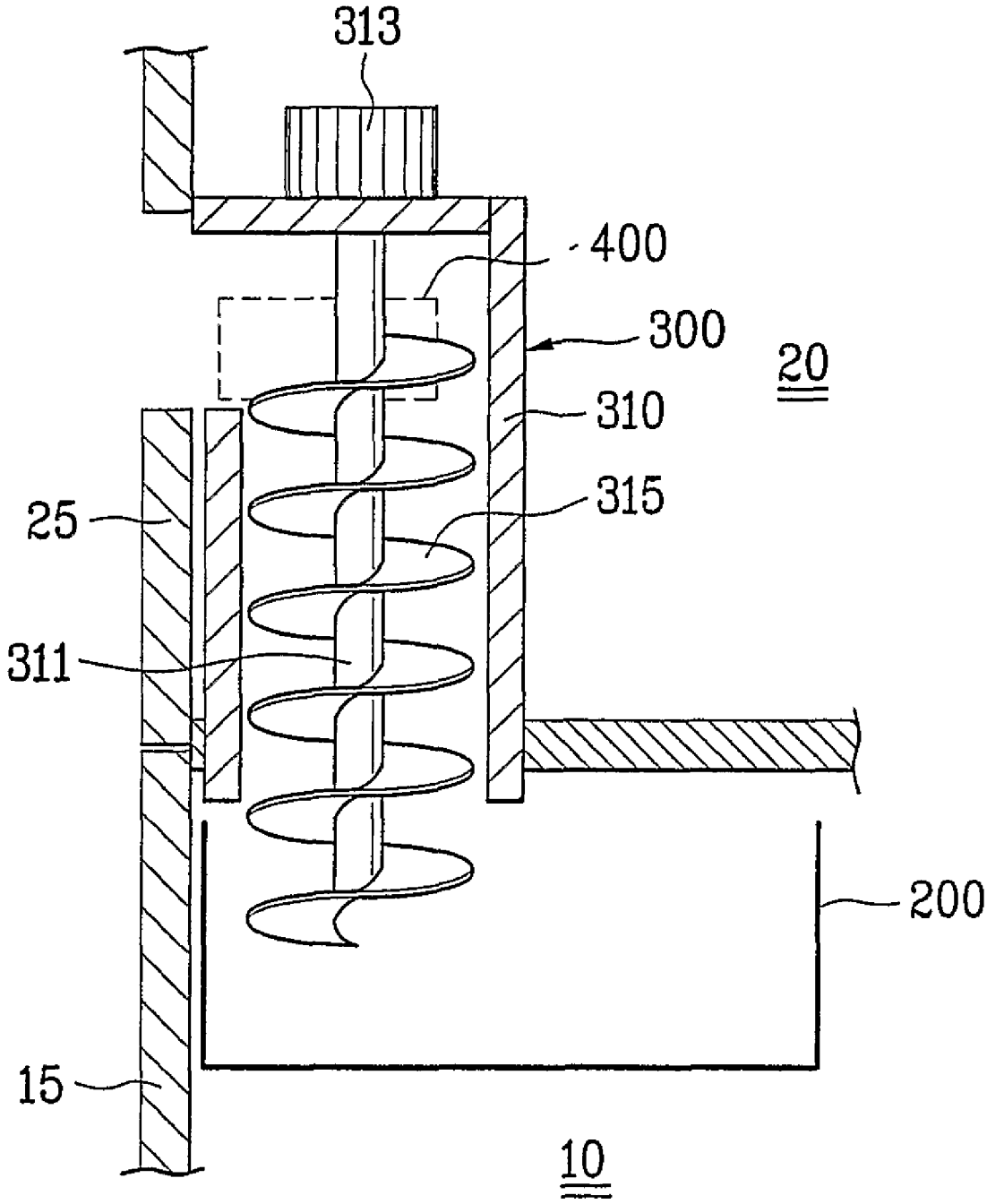
FIG. 4 is a cross sectional view of illustrating a lifter for lifting ice to a dispenser in a refrigerator of FIG. 4, according to the first embodiment of the present invention.

The lifter 300 is provided in the duct 310, for lifting the ice of the container 200 to the dispenser 30. The lifter 300 may be embodies in various modes, hereinafter, the preferred embodiments of the lifter according to the present invention will be described in detail. Referring to FIG. 4, the lifter 300 according to the first embodiment of the present invention is provided with a shaft 311 and a helical blade 315. In this case, the shaft 311 is positioned in the duct 310, and the helical blade 315 is positioned in an outer circumferential surface of the shaft 311. Also, the shaft 311 is provided in the duct 310 along a longitudinal direction, wherein the shaft 311 can be rotated in the duct 310. For this, the shaft 311 may be connected with a motor 313 provided in the outside of the duct 310 after passing through the upper end of the duct 310. In this state, the shaft 311 may be directly connected with the motor 313, or may be connected by a gear assembly. In the meantime, as shown in FIG. 4, the lower end of the shaft 311 is positioned for being inserted to the container 200.

Figure 5:
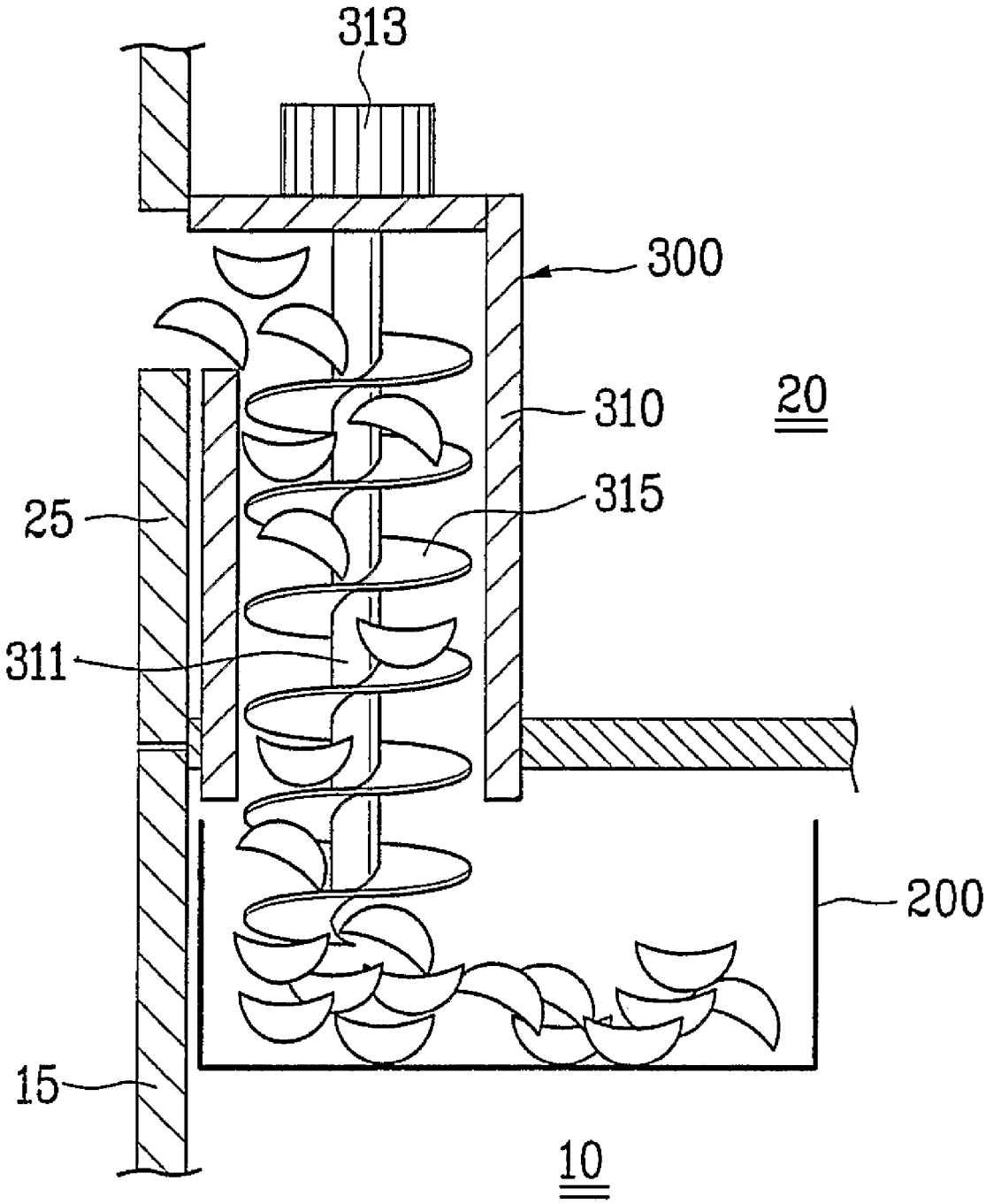
FIG. 5 is a diagram of illustrating the process for lifting ice to a dispenser by a lifter of FIG. 4.

As shown in FIG. 4, the helical blade 315 is formed to cover the outer surface of the shaft 311 from the lower end of the shaft 311 to one point of the upper part of the shaft 311. At this time, the lower end of the helical blade 315 is inserted to the inside of the container 200. Accordingly, as the shaft 311 rotates, as shown in FIG. 5, the ice of the container 200 is lifted to the dispenser 30 through the duct 310 by the helical blade 315. In the meantime, for example, the duct 310 is formed in a cylindrical shape, wherein a radius of the duct 310 is larger than a turning radius of the helical blade 315.

Figure 6:
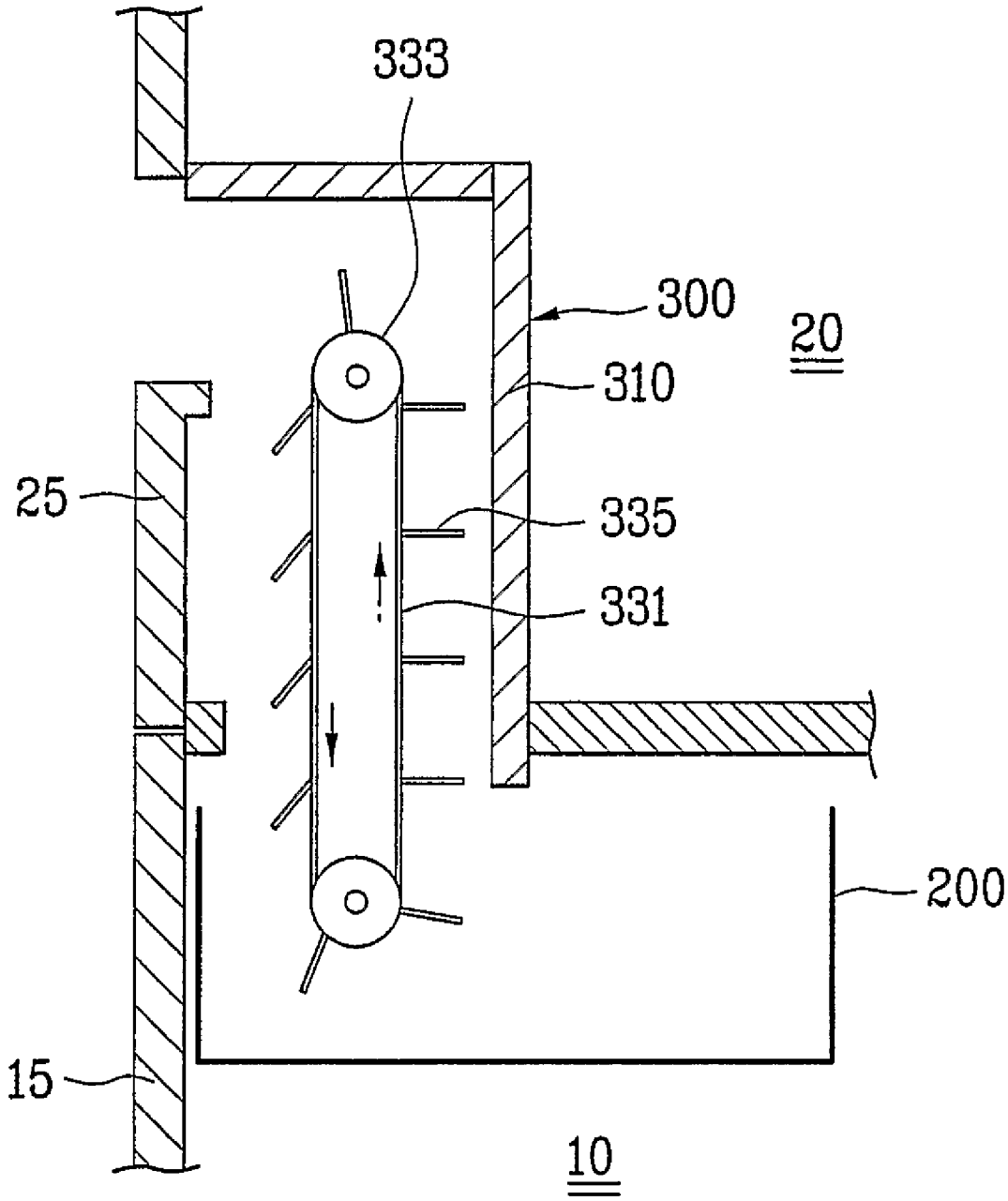
FIG. 6 is a cross sectional view of illustrating a lifter for lifting ice to a dispenser in a refrigerator of FIG. 1, according to the second embodiment of the present invention.

Referring to FIG. 6, the lifter 300 according to the second embodiment of the present invention is provided with a conveyor belt 331 and a bucket 335. In this case, a lower end of the conveyor belt 331 is positioned adjacent to the container 200, and more preferably, is positioned for being inserted into the container 200. Also, an upper end of the conveyor belt 331 is positioned adjacent to the dispenser 30. The conveyor belt 331 is positioned vertically or slantingly in the duct 310 provided between the container 200 and the dispenser 30. Also, the conveyor belt 331 rotates by driving rollers 333 provided in lower and upper parts of the duct 310.

As shown in FIG. 6, the bucket 335 is provided on the outer surface of the conveyor belt 311. For example, the bucket 335 is hingedly connected with the outer surface of the conveyor belt 331. As shown in FIG. 6, the bucket 335 is bent forward, but is not bent backward. That is, the bucket 335 is not bent more than 90°. Accordingly, when the conveyor belt 331 rotates, the bucket 335 takes up the ice of the container 200, and transports the taken ice to the dispenser 30. In the meantime, although not shown, instead of hingedly connecting the bucket 335 with the conveyor belt 331, it is possible to form the bucket 335 being projected on the outer surface of the conveyor belt 331 at a predetermined height.

Figure 7:
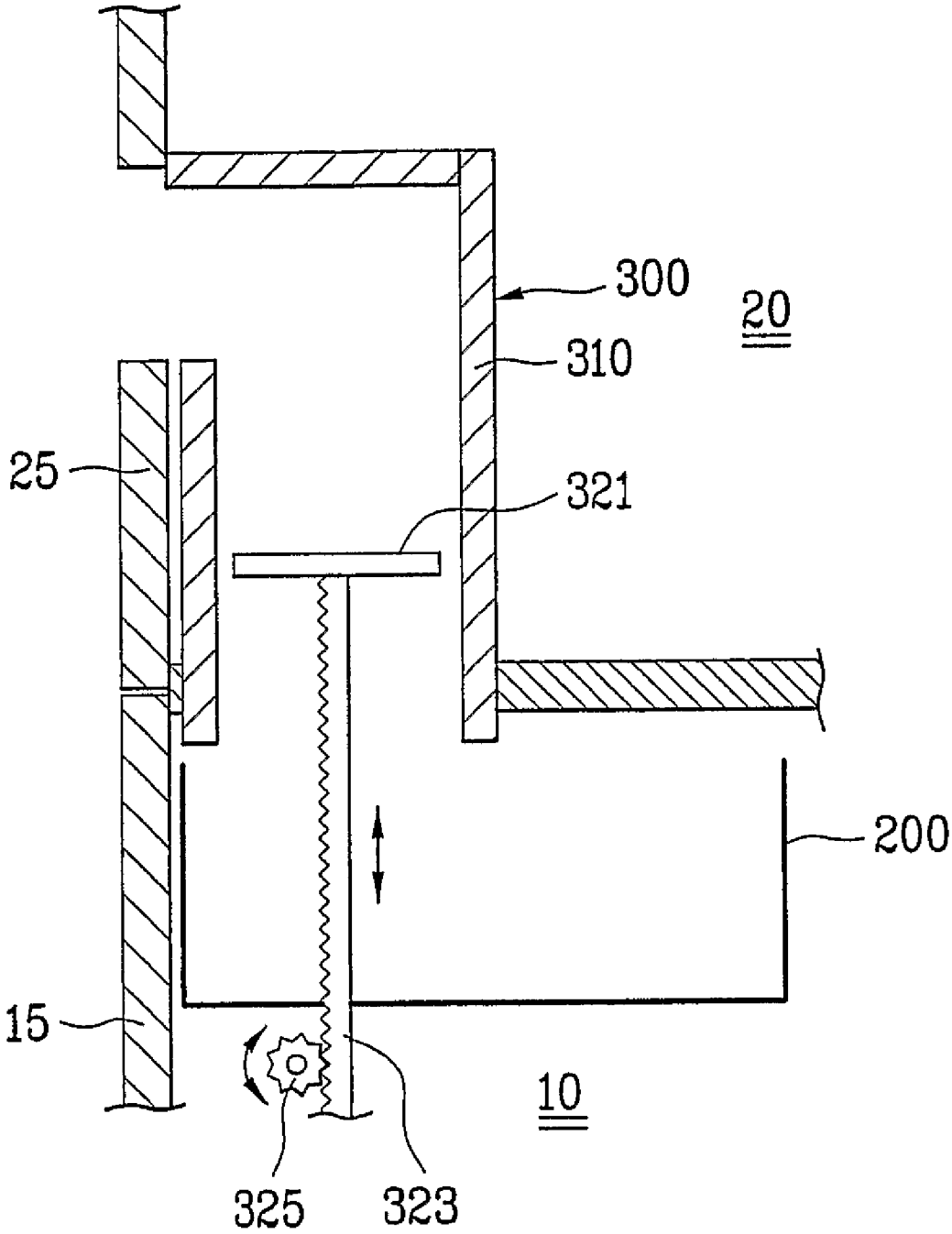
FIG. 7 is a cross sectional view of illustrating a lifter for lifting ice to a dispenser in a refrigerator of FIG. 1, according to the third embodiment of the present invention.

Referring to FIG. 7, the lifter 300 according to the third embodiment of the present invention is provided with a bucket 321 and an elevating mechanism. At this time, the bucket 321 moves up and down inside the duct 310, and the elevating mechanism makes the bucket 321 up and down. As shown in FIG. 7, the bucket 321 is provided between the container 200 and the dispenser 30, for transporting the ice stored in the container 200.

For example, at an initial state, the bucket 321 is positioned at the bottom of the container 200. Then, after making the ice in the icemaker 100, the ice dropped on the container 200 is put on the bucket 321. In this state, as the bucket 321 moves up by the elevating mechanism, the ice is transported to the dispenser 30. In another way, in state the ice made by the icemaker 100 may be stored in an additional container (not shown), the ice may be intermittently provided from the container (not shown) to the bucket 321. In this case, the container has a shutter (not shown), and the ice stored in the container (not shown) is provided to the bucket 321 according as the shutter is intermittently opened.

In the meantime, the elevating mechanism is connected with the bucket 321, whereby the bucket 321 moves up and down inside the duct 310. For example, the elevating mechanism is provided with a rack 323 and a pinion 325. The rack 323 is extended from the bucket 321, and the pinion 325 is engaged with the rack 323.

For example, as shown in FIG. 7, the rack 323 is extended downward from the bottom surface of the bucket 321, to pass through the container 200. Also, the pinion 325 is positioned below the container 200, for being engaged with the rack 323. In another way, although not shown, the rack 323 is extended upward from the bucket 321, to pass through the upper part of the duct 310. Also, the pinion 325 is engaged with the rack 323 in state the pinion 325 is positioned above the duct 310.

In the meantime, the refrigerator according to the present invention may be provided with a crusher assembly 400, wherein the crusher assembly 400 crushes the ice made in the icemaker 100. As shown in FIG. 4, the crusher assembly 400 is provided between the lifter 300 and the dispenser 30. The crusher assembly 400 crushes the ice transported by the lifter 300, and then the crusher assembly 400 supplies the crushed ice to the dispenser 30. Hereinafter, the crusher assembly 400 will be described with reference to FIG. 8.

The crusher assembly 400 is provided with an auxiliary container 410, a crusher 430, and a shutter 441. At this time, the auxiliary container 410 stores the ice therein, and the crusher 430 has a crushing blade 325 for crushing the ice stored in the auxiliary container 410. Also, the shutter 441 discharges the crushed ice to the outside of the auxiliary container 410.

The auxiliary container 410 has an open top for receiving and storing the ice dropped from the lifter 300. Also, an outlet 411 is provided at one side of the auxiliary container 410, for example, the bottom surface of the auxiliary container 410, for discharging the ice therethrough. In addition, the auxiliary container 410 has a transport device 420, wherein the transport device 420 transports the ice stored in the auxiliary container 410 to the outlet 411. For example, the transport device 420 is formed in a helical shape, for being across the inside of the auxiliary container 410. As the transport device 420 connected with a motor 415 rotates, the ice of the auxiliary container 410 is transported to the outlet 411.

Figure 8:
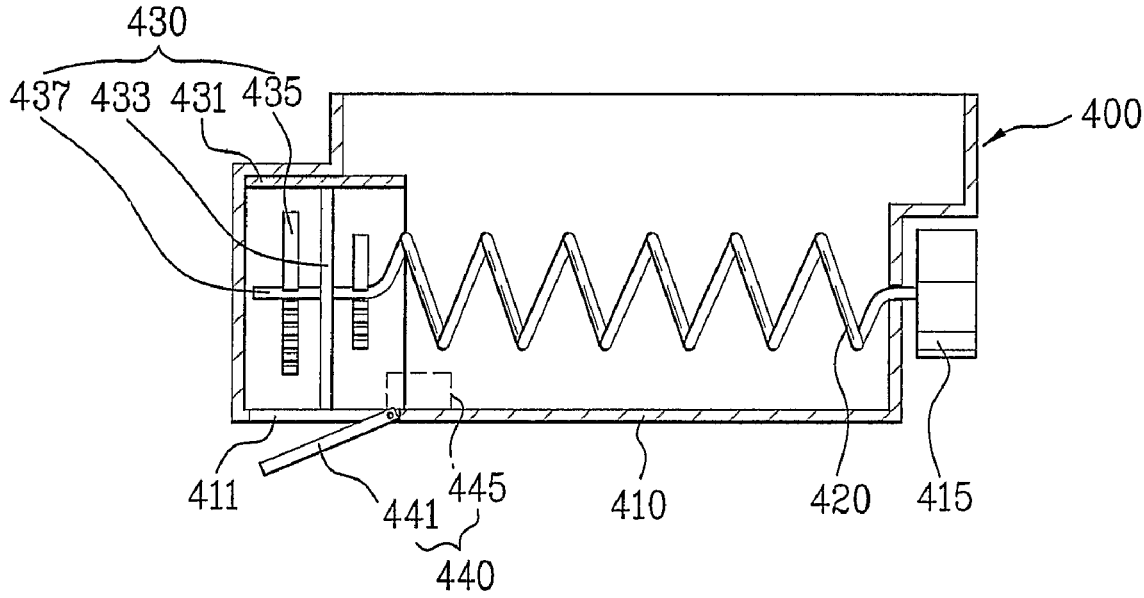
FIG. 8 is a cross sectional view of illustrating a crusher for crushing ice in a refrigerator of FIG. 1.

Also, the crusher 430 is provided at the side of the outlet 411 inside the auxiliary container 410, to crush the ice transported by the transport device 420. As shown in FIG. 8, the crusher 430 is provided with a housing 431, a shaft 437, a supporter 433, and a crushing blade 435.

The housing 431 is positioned above the outlet 411 inside the auxiliary container 410, and more specifically, the housing 431 has an open shape at an opposite surface to the transport device 420. The shaft 437 is horizontally provided in the housing 431, and the shaft 437 connected with the transport device 420 rotates together with the transport device 420. The shaft 437 may be fabricated as a separated body from the transport device 420, and then connected with the transport device 420. Or, as shown in FIG. 8, the shaft 437 may be formed in a shape being extended from one end of the transport device 420.

As shown in FIG. 3, the supporter 433 of supporting the shaft 437 is provided in the housing 431. That is, the shaft 437 passes through the supporter 433, whereby the shaft 437 rotates together with the transport device 420 at a predetermined portion of the housing 431. The crushing blade 435 is connected with the shaft 437. In this state, as the crushing blade 435 rotates together with the shaft 437, the crushing blade 435 crushes the ice transported by the transport device 420. Herein, at least one crushing blade 435 is provided in the crusher 430. In case of providing the plurality of crushing blades 435, as shown in FIG. 8, it is preferable to provide the crushing blades 435 at both sides of the support 433.

The auxiliary container 410 further includes an ice-discharging device 440 for selectively discharging the appropriate amount of ice. As shown in FIG. 8, the ice-discharging device 440 is provided with an actuator 445 and a shutter 441. The shutter 441 is formed in a plate shape, for opening and closing the outlet 411. For example, the shutter 441 is connected with the actuator 445 by a lever (not shown). At this time, the actuator 445 may be used of a solenoid type. In the aforementioned ice-discharging device 440, the actuator 445 is operated according to a control signal of the controller. Also, the extent of opening the outlet 411 is controlled by the operation of the actuator 445.

Hereinafter, an operation of the refrigerator according to the present invention will be described as follows.

First, the controller (not shown) determines that the container 200 is short in the ice supply by the sensing arm 180, so that water is supplied to the water supplying part 120 of the icemaker 100. Then, the water supplied to the water supplying part 120 is filled into the space between the respective ribs 111 of the ice tray 110, and the water is frozen with the cool air of the freezer 10, thereby making the many pieces of ice in the ice tray 110, the pieces of ice having the particular size by the ribs 111.

On completion of making the pieces of ice in a predetermined period, the heater 170 heats the surface of the ice tray 110 for a short time, and slightly melts the ice on the surface of the ice tray 110. Thus, the pieces of ice in the ice tray 11 are easily separated from the ice tray 110. Subsequently, as the motor 130 operates, the shaft 141 and the pin 145 rotate together. Accordingly, the pin 145 pushes the ice positioned between the ribs 111 to the circumstance direction of the ice tray 110. Thus, the ice piece separated from the ice tray 110 by the pin 145 is dropped on the strip 160, and then dropped to the lower side of the icemaker 100. Then, the dropped ice piece is received in the container 200.

On repetition of the aforementioned process, if the predetermined amount of ice is filled in the container 200, the amount of ice filled in the container 200 is measured with the sensing arm 180, and then the controller stops the production of ice. If the sensing arm 180 determines that the amount of ice in the container 200 is not enough, the process of making the ice is repetitively performed, and the made ice is stored in the container 200.

In the meantime, in state the container 200 is filled with the ice pieces, the user operates a control panel or the lever (not shown) of the dispenser 30, so that the user can have the crushed ice through the dispenser 30. Hereinafter, this process will be described in detail.

As operating the control panel or the lever of the dispenser 30, the lifter 300 operates, so that the ice stored in the container 200 is transported through the duct 310. Then, the ice is stored in the auxiliary container 410 of the crusher assembly 400. The ice stored in the auxiliary container 410 is transported by the transport device 420, and crushed by the crusher 430. After that, the crushed ice is supplied to the user through the dispenser 30 when the shutter 441 is opened.

In the meantime, the lifter 300 may be rotated at the opposite direction. For example, after the predetermined amount of ice is supplied to the user through the dispenser 30, the lifter 300 rotates at the reverse direction, to store the remaining ice of the duct 310 in the container 200. However, if the cool air of the freezer 10 is supplied to the duct 310 and the crusher assembly 400, there is no requirement for rotating the lifter 300 at the reverse direction.

In the aforementioned embodiment, the crusher assembly 400 is provided between the lifter 300 and the dispenser 30. However, although not shown, the crusher assembly 400 may be provided between the icemaker 100 and the container 200, or may be provided inside the container 200.

First, the case of providing the crusher assembly 400 between the icemaker 100 and the container 200 will be described as follows. In this case, the ice made in the icemaker 100 is dropped on and stored in the auxiliary container 410 of the crusher assembly 400. Then, the transport device 420 transports the ice stored in the auxiliary container 410 to the crusher 430, and then the crusher 430 crushes the transported ice. After that, the ice crushed by the crusher 430 is dropped to and stored in the container 200 when the shutter 441 is open. The crushed ice stored in the container 200 is transported to the dispenser 30 through the duct 310 by the lifter 300, and then the crushed ice is supplied to the user.

Next, the case of providing the crusher assembly 400 inside the container 200 will be described as follows. In this case, the crusher assembly 400 is provided with the transport device 420, the shaft 437, and the crushing blade 435. The transport device 420 and the shaft 437 are provided across the container 200. Also, the shaft 437 and the crushing blade 435, for example, are provided in the center of the transport device 420. Accordingly, the ice made in the icemaker 100 and stored in the container 200 is transported to one side of the container 200 by the transport device 420, and the ice transported in the container 200 is crushed with the crushing blade 435. Then, the crushed ice transported to one side of the container 200 is moved upward by the lifter 300, and then supplied to the user through the dispenser 30.

INDUSTRIAL APPLICABILITY

As mentioned above, the refrigerator according to the present invention has the following advantages.

In the refrigerator according to the present invention, the cooling chamber is provided in the upper part of the refrigerator, and the freezer is provided in the lower part of the refrigerator. Accordingly, this structure is useful in that the cooling chamber is more frequently used. That is, the user can use the cooling chamber without bending.

In addition, in case of the refrigerator according to the present invention, the dispenser is provided at the door positioned in the upper part of the refrigerator, so that the dispenser is positioned in correspondence to the waist or breast height of the user. Thus, the user can have water and ice without bending down.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A refrigerator having an icemaker comprising:
a dispenser provided in a door;
an icemaker for making ice by using a cool air of a freezer;
a container for receiving and storing the ice discharged from the icemaker; and
a lifter provided between the dispenser and the container, for lifting the ice stored in the container to the dispenser, wherein the lifter includes:
a bucket, between the container and the dispenser, to lift the ice stored in the container to the dispenser; and
an elevator, coupled to the bucket, to move the bucket in the duct, the elevator comprising:
an extended member that extends downwardly or upwardly from the bucket, and
an actuator that engages the extended member to move the extended member upwardly or downwardly.

2. The refrigerator as claimed in claim 1, wherein the freezer is positioned in a lower part of the refrigerator, and a cooling chamber is positioned in an upper part of the refrigerator.

3. The refrigerator as claimed in claim 1, wherein the door is provided to open and close the cooling chamber positioned above the freezer.

4. The refrigerator as claimed in claim 1 wherein the icemaker includes:
an ice tray for receiving water therein; and
an ejector, rotatably provided above the ice tray, to discharge the ice of the ice tray.

5. The refrigerator as claimed in claim 4, wherein the icemaker further includes inclined strips that extend from an upper part of the ice tray to guide the ice discharged to an upper side by the ejector.

6. The refrigerator as claimed in claim 4, wherein the icemaker further includes a sensing arm that intermittently moves downward to measure an amount of ice stored in the container.

7. The refrigerator as claimed in claim 4, wherein the container is positioned below the ice tray, and has an open top for receiving the ice dropped from the icemaker.

8. The refrigerator as claimed in claim 2, wherein the lifter is extended from the cooling chamber to the freezer.

9. The refrigerator as claimed in claim 1, further comprising
a duct for forming a path of ice, transported by the lifter, between the dispenser and the container.

10. The refrigerator as claimed in claim 2, further comprising
a duct, that extends from the cooling chamber to the freezer, to form a path of ice transported by the lifter.

11. A refrigerator having an icemaker, comprising:
a dispenser provided in a door;
an icemaker for making ice by using a cool air of a freezer;
a container for receiving and storing the ice discharged from the icemaker; and
a lifter, provided between the dispenser and the container, for lifting the ice stored in the container to the dispenser, wherein the lifter includes:
a bucket, between the container and the dispenser, to lift the ice stored in the container to the dispenser; and
an elevator, coupled to the bucket, to move the bucket in the duct, wherein the elevator includes:
a rack coupled to the bucket; and
a pinion being engaged with the rack.

12. The wherein the refrigerator further comprises:
a crusher, between the lifter and the dispenser, to crush the ice transported by the lifter, the crushed ice to be supplied to the dispenser.

13. The refrigerator as claimed in claim 12, wherein the crusher assembly includes:
an auxiliary container for storing the ice transported by the lifter;
a crushing blade, rotatably provided in the auxiliary container, to crush the ice; and
a shutter, in the auxiliary container, to supply the crushed ice to the dispenser.

14. A refrigerator having an icemaker comprising:
a freezer positioned in a lower part of the refrigerator, the icemaker provided in the freezer, for making ice;
a cooling chamber positioned above the freezer;
a dispenser provided in a door for opening and closing the cooling chamber;
a container provided in the freezer, for receiving and storing the ice discharged from the icemaker; and
a lifter for transporting the ice stored in the container to the dispenser, wherein the lifter includes:
a bucket, between the container and the dispenser, to lift the ice stored in the container to the dispenser; and
an elevator, coupled to the bucket, to move the bucket in the duct, the elevator comprising:
an extended member that extends downwardly or upwardly from the bucket, and
an actuator that engages the extended member to move the extended member upwardly or downwardly.

15. The refrigerator as claimed in claim 14, wherein the lifter is extended from the cooling chamber to the freezer.

* * * * *